US009140003B1

(12) United States Patent
Gretz

(10) Patent No.: US 9,140,003 B1
(45) Date of Patent: Sep. 22, 2015

(54) SILLCOCK SHROUD FOR WEATHERPROOFING A SILLCOCK

(71) Applicant: Arlington Industries, Inc., Scranton, PA (US)

(72) Inventor: Thomas J. Gretz, Port St. Lucie, FL (US)

(73) Assignee: Arlington Industries, Inc., Scranton, PA (US)

( * ) Notice: Subject to any disclaimer, the term of this patent is extended or adjusted under 35 U.S.C. 154(b) by 0 days.

(21) Appl. No.: 14/175,374

(22) Filed: Feb. 7, 2014

Related U.S. Application Data

(60) Provisional application No. 61/762,990, filed on Feb. 11, 2013.

(51) Int. Cl.
*E04C 2/52* (2006.01)
*E04B 1/64* (2006.01)

(52) U.S. Cl.
CPC ..... *E04B 1/64* (2013.01)

(58) Field of Classification Search
CPC ..... E04D 13/1407
USPC ..... 52/220.1, 97; 248/56
See application file for complete search history.

(56) References Cited

U.S. PATENT DOCUMENTS

| | | | | | |
|---|---|---|---|---|---|
| 791,068 | A * | 5/1905 | Baker | 285/43 |
| 2,800,850 | A * | 7/1957 | McKann | 454/3 |
| 3,889,909 | A * | 6/1975 | Koscik | 248/56 |
| 5,526,619 | A * | 6/1996 | Vagedes | 52/220.1 |
| 5,918,431 | A * | 7/1999 | Schiedegger et al. | 52/220.1 |
| 6,860,070 | B2 * | 3/2005 | Gilleran | 52/35 |
| 7,534,965 | B1 * | 5/2009 | Thompson | 174/153 G |
| 7,568,314 | B2 * | 8/2009 | Collins | 52/60 |
| 7,878,463 | B2 * | 2/2011 | Kauppila | 248/65 |
| 7,954,286 | B2 * | 6/2011 | Khan et al. | 52/219 |
| 8,047,483 | B2 * | 11/2011 | Bonshor | 248/205.1 |
| 8,161,696 | B2 * | 4/2012 | Colwell et al. | 52/220.8 |
| 8,240,093 | B2 * | 8/2012 | Lajewski | 52/97 |

* cited by examiner

*Primary Examiner* — Basil Katcheves

(57) ABSTRACT

A weatherproofing shroud for weatherproofing a sillcock or faucet. The weatherproofing shroud includes a top trim piece and a bottom trim piece that are fitted together to form a continuous waterproofing channel around a sillcock or faucet. The top trim piece and bottom trim piece each include a base flange and an outer flange that, when joined together, define a J-shaped channel for accepting the insertion siding, stucco, or other exterior finishes. The top trim piece and bottom trim piece each include an arcuate seat for sealing around the pipe section of a sillcock. A base flange extension on the top trim piece fits over a corresponding top flange on the bottom trim piece to further direct any water falling thereon to run off of the shroud. The weatherproofing shroud can be used in new home construction or on existing structures.

17 Claims, 6 Drawing Sheets

SILLCOCK SHROUD FOR WEATHERPROOFING A SILLCOCK

This application claims the priority of U.S. Provisional Application Ser. No. 61/762,990 filed Feb. 11, 2013.

FIELD OF THE INVENTION

The present invention relates to the water faucets on buildings and specifically to a shroud for providing a weatherproof covering for surrounding a sillcock or faucet installed on a building.

BACKGROUND OF THE INVENTION

Sillcocks and faucets are installed on buildings to provide a water outlet for the connection of hoses. Sillcocks and flanges typically include an integral flange that is mounted against the exterior wall of the building. The integral flange however is relatively small and has proven to be inadequate for providing a weatherproof sillcock or faucet, especially for exterior finishes having uneven or grooved surfaces, such as many types of siding, corrugated steel or aluminum, or shingles. As a result of the uneven surface on the cladding, it is difficult to obtain a weatherproof sillcock installation on the exterior wall of a building, and this generally leads to leakage around the sillcock or faucet and, over time, degradation of the surrounding cladding.

Accordingly, there is a need for a device that obtains a weatherproof installation and allows rain or water to run off of the sillcock or faucet and the surrounding surface and thereby prevent leakage.

BRIEF SUMMARY OF THE INVENTION

The current invention is a weatherproofing shroud for a sillcock or faucet. The weatherproofing shroud includes a top trim piece and a bottom trim piece that are fitted together to form a continuous waterproofing channel around a sillcock or faucet. The top trim piece and bottom trim piece each include a base flange and an outer flange that, when joined together, define a J-shaped channel for accepting the insertion of cladding. The top trim piece and bottom trim piece also each include an arcuate seat for sealing around the pipe section of a sillcock or faucet. A base flange extension on the top trim piece fits over a corresponding top flange on the bottom trim piece to further force any water falling thereon to run off of the shroud. The weatherproofing shroud can be used in new home construction or on existing structures.

OBJECTS AND ADVANTAGES

One object of the current invention is to provide a shroud for forming a weatherproof seal around a sillcock or faucet.

A further object is to provide a shroud with a J-shaped channel for repelling water from a sillcock or faucet.

A further object is to provide a shroud with a top trim piece and a bottom trim piece for sealing around a sillcock or faucet.

BRIEF DESCRIPTION OF THE SEVERAL VIEWS OF THE DRAWING(S)

Reference is made herein to the accompanying drawings, which are not necessarily drawn to scale, and wherein.

DETAILED DESCRIPTION

Figure 1:
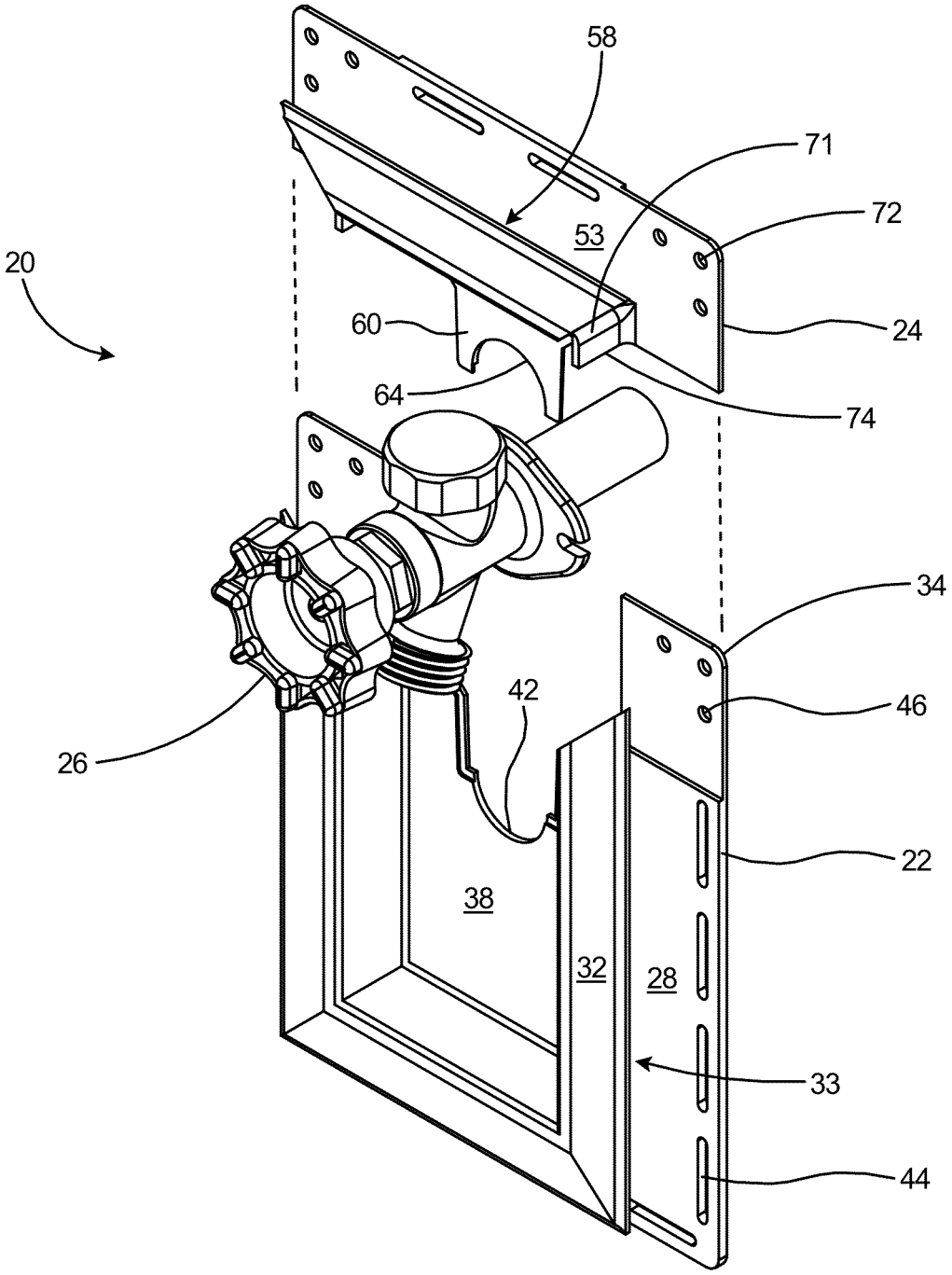
FIG. 1 is an exploded isometric view of a weatherproofing shroud in alignment for installation to a hose sillcock in accordance with embodiments of the invention.

With reference to FIG. 1, the weatherproofing shroud 20 of the present invention includes a bottom trim piece 22 and a top trim piece 24 that assemble together in order to provide a seal around the hose sillcock 26 and to provide a channel for removing rain or water from around the periphery of the sillcock 26.

Figure 2:
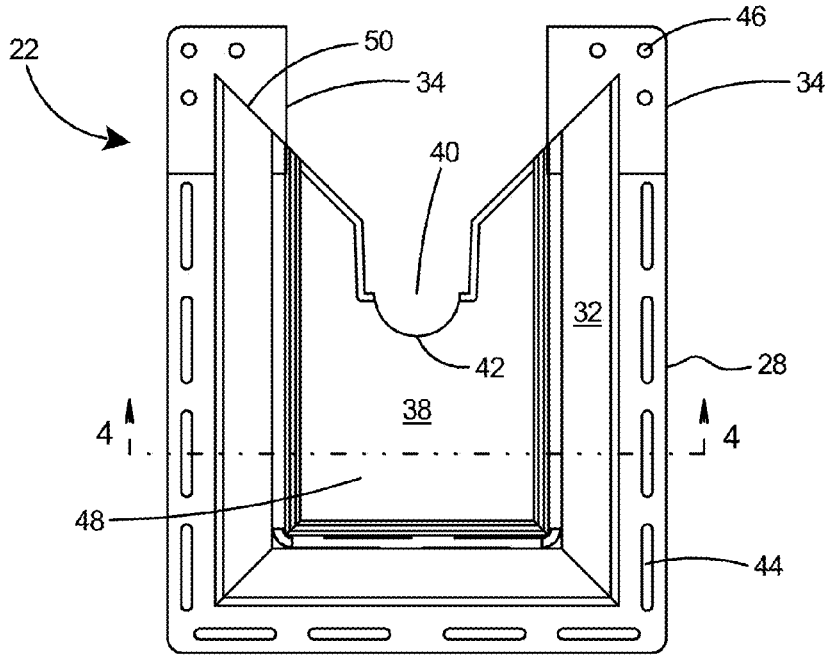
FIG. 2 is a front elevation view of a bottom piece which forms a portion of the weatherproofing shroud of FIG. 1.
Figure 3:
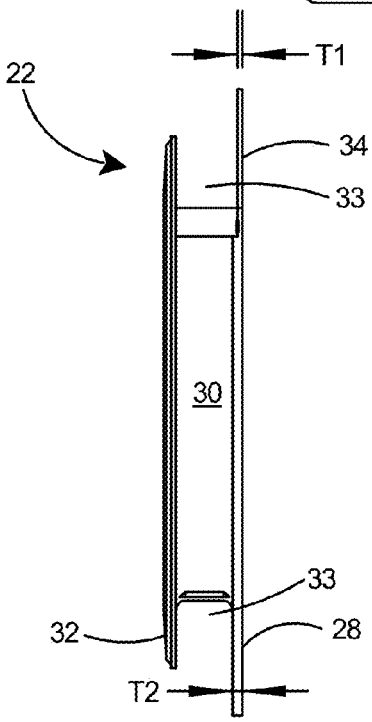
FIG. 3 is a side view of the bottom piece of FIG. 2.
Figure 4:
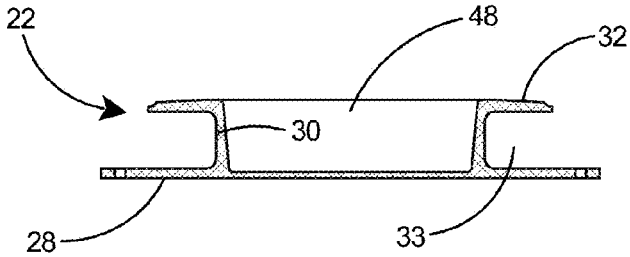
FIG. 4 is a sectional view of the bottom piece taken along line 4-4 of FIG. 2.
Figure 5:
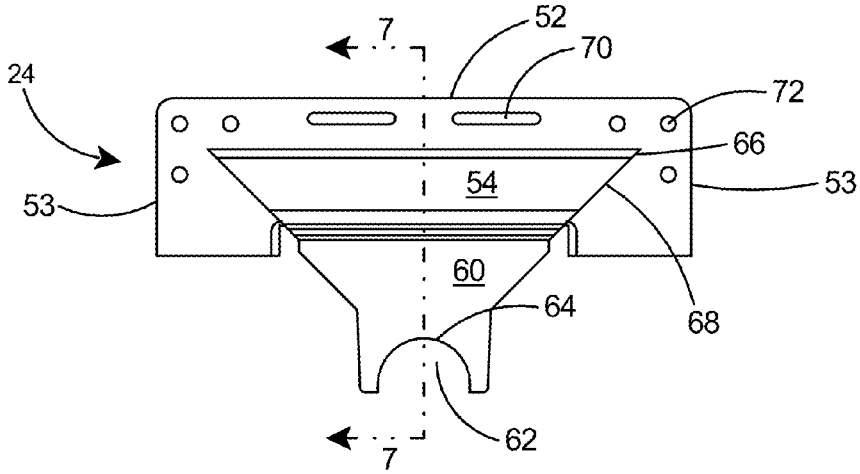
FIG. 5 is a front elevation view of a top piece which forms a portion of the weatherproofing shroud of FIG. 1.

Referring to FIGS. 2-4, the bottom trim piece 22 includes a base flange 28, a peripheral wall 30 extending outward from the base flange 28 along three sides of the bottom trim piece, and an outer flange 32. A J-shaped channel 33 is formed by the base flange 28, peripheral wall 30, and outer flange 32 of the bottom trim piece 22. Two top flanges 34 are integral with and extend from the base flange 28. A back wall 38 extends between the peripheral wall 30 and includes a notch 40 with a bottom arcuate seat 42 therein. Base flange 28 includes a plurality of slots 44 therein and top flanges 34 include a plurality of apertures 46 therein. An open space 48 extends between the portions of the outer flange 32 of bottom trim piece 22. The outer flange 32 of bottom trim piece 22 further includes a substantially V-shaped top edge 50. As shown in FIG. 3, the top flanges 34 include a thickness T1 and the base flange 28 includes a thickness T2. Preferably the thickness of top flanges 34 is about half the thickness of the base flange 28.

Figure 6:
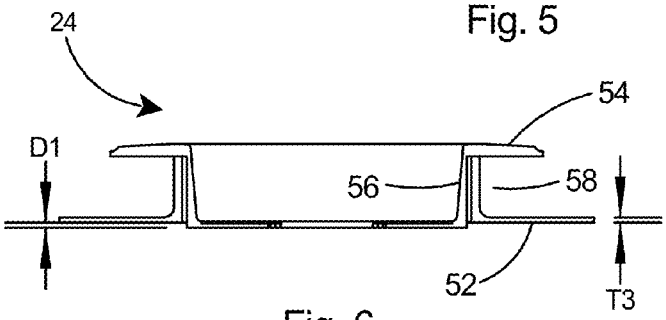
FIG. 6 is an end view of the top piece as viewed from the bottom of FIG. 5.
Figure 7:
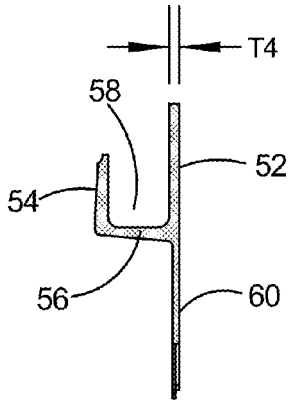
FIG. 7 is a sectional view of the top piece taken along line 7-7 of FIG. 5.
Figure 8:
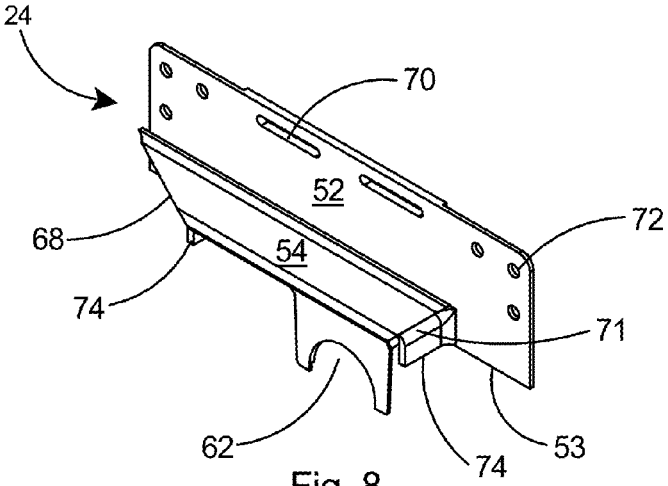
FIG. 8 is a top isometric view of the top piece.
Figure 9:
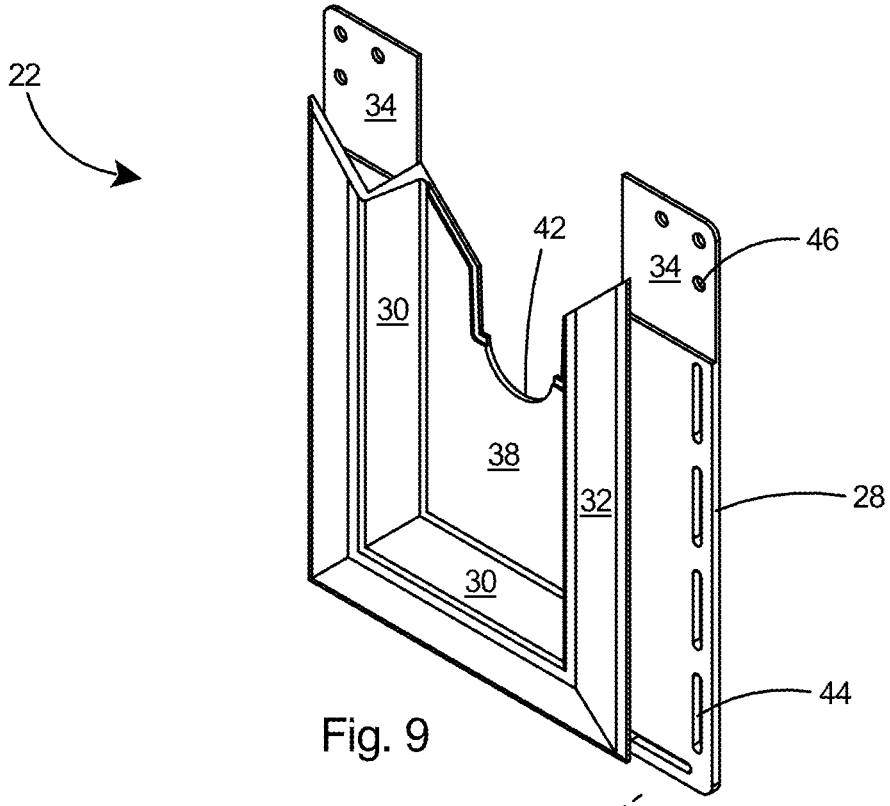
FIG. 9 is a top isometric view of the bottom piece.

With reference to FIGS. 5-8, top trim piece 24 includes a base flange 52, two base flange extensions 53, an outer flange 54, and a peripheral wall 56 extending between the base flange 52 and outer flange 54. A J-shaped channel 58 is formed by the base flange 52, peripheral wall 56, and outer flange 54 of the top trim piece 24. A partial back wall 60 is integral with and extends from the base flange 52 and includes a notch 62 with a top arcuate seat 64 therein. The ends 66 of the outer flange 54 terminate in an angled edge 68. As shown in FIG. 6, preferably the thickness T3 of each base flange extension 53 is about half the thickness of the base flange 52 of the top trim piece 24 denoted as thickness T4 in FIG. 7. Base flange extensions 53 are preferably offset from the partial back wall 60 by distance D1 as shown in FIG. 6. Base flange 52 of top trim piece 24 includes a plurality of slots 70 therein and base flange extensions 53 include a plurality of apertures 72 therein. The peripheral wall 56 of top trim piece 24 includes ends 71 and a leg 74 integral with and extending downward from each end 71 of peripheral wall 56.

Figure 10:
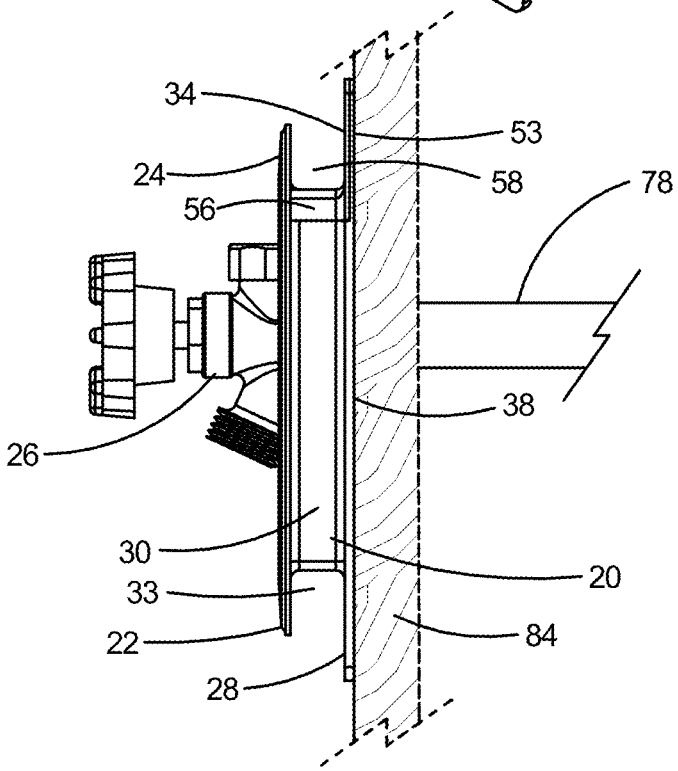
FIG. 10 is a side view of the weatherproofing shroud installed around a hose sillcock.
Figure 12:
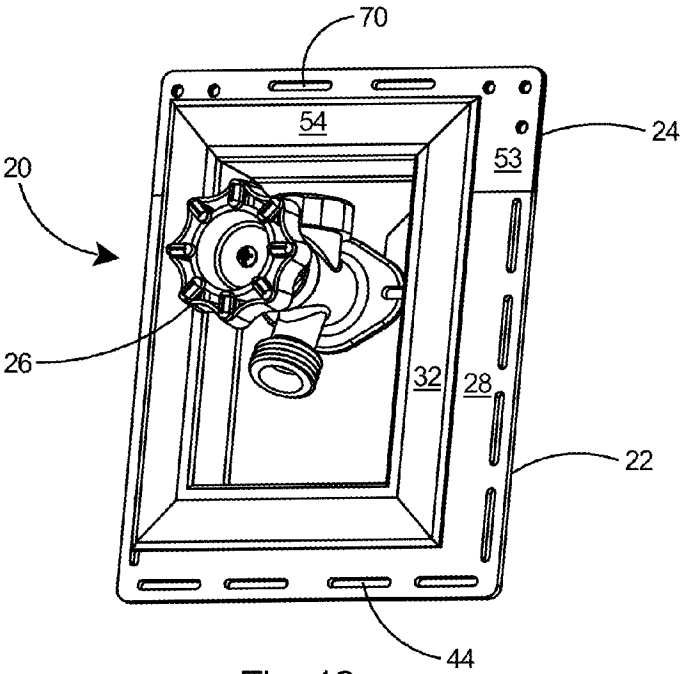
FIG. 12 is an isometric view of the weatherproofing shroud of the present invention installed around a hose sillcock on a building.
Figure 11:
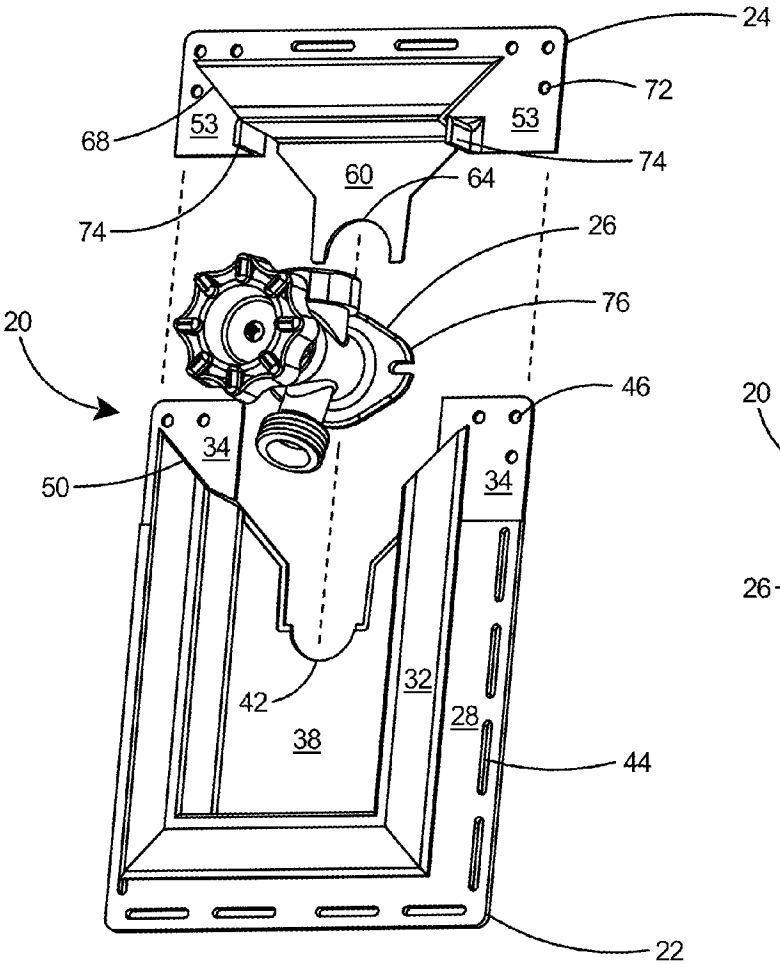
FIG. 11 is an exploded isometric view of the weatherproofing shroud of the present invention in alignment for installation to a hose sillcock in accordance with embodiments of the invention.

Referring to FIG. 11, the weatherproofing shroud 20 of the present invention is used to provide a means of sealing around the sillcock's rearward extending pipe and provide a channel for accommodating siding, stucco, or any exterior finish. To operate the weatherproofing shroud 20, the bottom trim piece 22 is slipped under the flange 76 of the sillcock 26 until bottom arcuate seat 42 seats against the rearward extending pipe 78 of the sillcock 26 (see FIG. 10). Bottom trim piece 22 can be secured to the wall by fasteners (not shown) driven through slots 44. Top trim piece 24 is then slid downward under the flange 76 of the sillcock 26 until base flange extensions 53 of top trim piece 24 slip over top flanges 34 of bottom trim piece 22 and top arcuate seat 64 engages the rearward extending piper 78 of the sillcock. Apertures 72 in base flange extensions 53 of top trim piece 24 should then be in axial alignment with apertures 46 in top flanges 34 of bottom trim piece 22. With the apertures 72 and 46 in alignment, fasteners can be driven through the base flange extensions 53 of overlapped trim pieces 24 and 22 thereby securing the sillcock shroud 20 to the wall.

Figure 14:
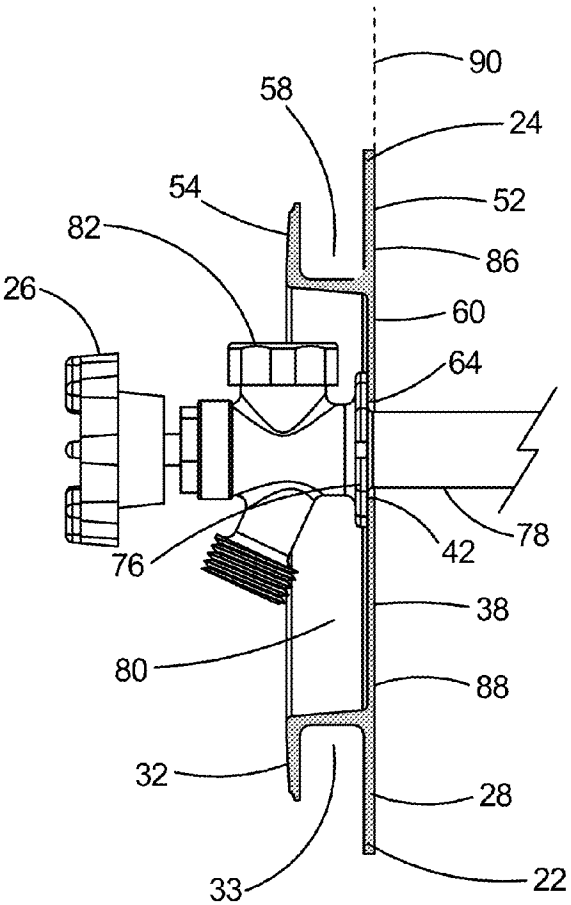
FIG. 14 is a sectional view of the weatherproofing shroud taken along line 14-14 of FIG. 13.
Figure 13:
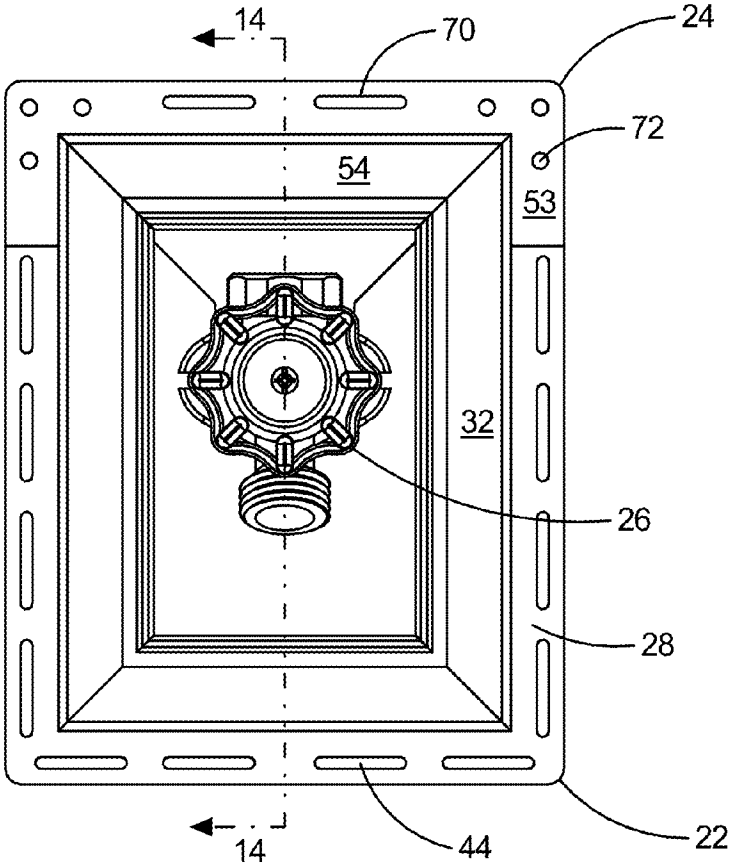
FIG. 13 is a front elevation view of the weatherproofing shroud of the present invention installed around a hose sillcock on a building.

With reference to FIGS. 13-14, the weatherproofing shroud 20 provides a channel for accepting siding, stucco, or any exterior finish and prevents water from seeping behind the exterior finish surrounding the sillcock or faucet. As shown in FIG. 14, top arcuate seat 64 of top trim piece 24 seats against the top of the rearward extending pipe 78 of the sillcock 26 and bottom arcuate seat 42 of bottom trim piece 22 seats against the bottom of the rearward extending pipe 78. Back wall 38 and base flange 28 of bottom trim piece 22 and base flange 52 of top trim piece 22 fit flush against the substrate. A J-shaped channel is provided all around the weatherproofing shroud including J-shaped channel 58 at the top periphery of the top trim piece 22 and J-shaped channel 33 around the periphery of the bottom trim piece 22. The weatherproofing shroud 20 provides a recessed area 80 for protecting a portion of the sillcock 26, including a part of the vacuum breaker assembly 82. The recessed area 80 is formed by the peripheral wall 56 of the bottom trim piece 22 and the peripheral wall 30 of the bottom trim piece 22. The J-shaped channels 33 and 58 furthermore provide a deep channel for accepting siding (not shown) and occluding the siding surrounding the sillcock from view.

With reference to FIG. 10, there is shown the weatherproofing shroud 20 of the present invention installed on the outer substrate 84 of a building. Weatherproofing shroud 20 provides a wide channel 58 at the top of the top trim piece 24 and a wide channel 33 around the periphery of the bottom trim piece 22 for acceptance of siding therein. As shown in FIG. 14, the top trim piece 24 and the bottom trim piece 22 are joined such that the back surface 86 of the top trim piece 24 and the back surface 88 of the bottom trim piece 22 are in a common plane 90.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A two-piece weatherproofing shroud comprising:

a top trim piece including a base flange including a back surface, an outer flange substantially parallel to said base flange, and a peripheral wall between said base flange and said outer flange;

a bottom trim piece including a base flange including a back surface, an outer flange substantially parallel to said base flange, and a peripheral wall between said base flange and said outer flange;

said base flange and said peripheral wall of said top trim piece adapted to overlap said base flange and said peripheral wall of said bottom trim piece when said top trim piece and said bottom trim piece are joined such that said back surface of said top trim piece and said back surface of said bottom trim piece are in a common plane;

said base flange, said outer flange, and said peripheral wall of said top trim piece form a continuous channel on said top trim piece;

said base flange, said outer flange, and said peripheral wall of said bottom trim piece form a continuous channel on said bottom trim piece;

ends on said peripheral wall of said top trim piece; and a leg integral with and extending downward from each of said ends of said peripheral wall of said top trim piece.

2. The weatherproofing shroud of claim 1 including a bottom arcuate seat on said bottom trim piece; and a top arcuate seat on said top trim piece.

3. The weatherproofing shroud of claim 2 including a back wall on said bottom trim piece.

4. The weatherproofing shroud of claim 3 including a notch in said back wall of said bottom trim piece.

5. The weatherproofing shroud of claim 4 wherein said notch in said bottom trim piece includes said top arcuate seat.

6. The weatherproofing shroud of claim 1 including a base flange extension on said top trim piece; and a top flange on said bottom trim piece.

7. The weatherproofing shroud of claim 6 wherein said top flange on said bottom trim piece includes a thickness;

said base flange on said top trim piece includes a thickness; and said thickness of said top flange on said bottom trim piece is about half the thickness of said thickness of said base flange on said bottom trim piece.

8. The weatherproofing shroud of claim 6 wherein said base flange extension of said top trim piece includes a thickness;

said base flange of said top trim piece includes a thickness; and said thickness of said base flange extension of said top trim piece is about half of said thickness of said base flange of said top trim piece.

9. The weatherproofing shroud of claim 6 wherein said base flange extension of said top trim piece includes apertures therein.

10. The weatherproofing shroud of claim 9 wherein said top flange of said bottom trim piece includes apertures therein.

11. The weatherproofing shroud of claim 10 wherein joining of said top trim piece and said bottom trim piece axially aligns said apertures in said base flange extension of said top trim piece with said apertures in said top flange of said bottom trim piece.

12. The weatherproofing shroud of claim 1 wherein said outer flange of said bottom trim piece includes a substantially V-shaped top edge.

13. The weatherproofing shroud of claim 1 including a recessed area formed by said peripheral wall of said top trim piece and said peripheral wall of said bottom trim piece.

14. The weatherproofing shroud of claim 1 including a plurality of slots in said base flange of said top trim piece and a plurality of slots in said base flange of said bottom trim piece.

15. The weatherproofing shroud of claim 1 including a partial back wall integral with and extending from said base flange of said top trim piece.

16. The weatherproofing shroud of claim 15 including a notch in said partial back wall of said top trim piece.

17. The weatherproofing shroud of claim 16 wherein said notch in said top trim piece includes said top arcuate seat.

* * * * *